US006691487B2

(12) United States Patent
Daudet

(10) Patent No.: US 6,691,487 B2
(45) Date of Patent: Feb. 17, 2004

(54) APPARATUS FOR REINFORCING A PORTION OF A METAL JOIST ADJACENT AN OPENING THERETHROUGH AND METHODS FOR FORMING REINFORCED OPENINGS IN METAL SUPPORT MEMBERS

(75) Inventor: Larry R. Daudet, Porter, IN (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 10/005,663

(22) Filed: Nov. 8, 2001

(65) Prior Publication Data

US 2003/0084637 A1 May 8, 2003

(51) Int. Cl.[7] ..... E04C 3/30

(52) U.S. Cl. ..... 52/731.7; 712/220.8; 285/64; 174/48

(58) Field of Search ..... 52/712, 713, 715, 52/729.5, 730.1, 731.7, 737.2, 737.6, 634, 696, 220.1, 220.8, 702, 232; 285/64; 454/270, 271; 126/633; 138/156–158; 174/48, 50, 68.1

(56) References Cited

U.S. PATENT DOCUMENTS

| | | | | |
|---|---|---|---|---|
| 1,791,197 A | | 2/1931 | Dickson | |
| 3,322,447 A | | 5/1967 | Biggs | |
| 4,235,054 A | | 11/1980 | Cable et al. | |
| 4,860,791 A | * | 8/1989 | Putnam | 137/565 |
| 5,287,664 A | * | 2/1994 | Schiller et al. | 52/220.1 |
| 5,488,198 A | * | 1/1996 | Kramer | 174/48 |
| 5,519,977 A | | 5/1996 | Callahan et al. | 52/712 |
| 5,524,397 A | * | 6/1996 | Byers et al. | 52/92.2 |
| 5,904,023 A | | 5/1999 | diGirolamo et al. | |
| 5,964,071 A | | 10/1999 | Sato | |
| 6,241,199 B1 | * | 6/2001 | Ismert | 248/56 |
| 6,301,854 B1 | | 10/2001 | Daudet et al. | |
| 6,463,712 B1 | * | 10/2002 | Kolanko et al. | 52/720.1 |
| 2002/0059773 A1 | | 5/2002 | Elderson | |
| 2003/0089053 A1 | | 5/2003 | Elderson | |
| 2003/0106280 A1 | | 6/2003 | diGirolamo | |

FOREIGN PATENT DOCUMENTS

WO PCT/US00/11991 11/2000

OTHER PUBLICATIONS

U.S. patent application Ser. No. 09/959,036, Elderson.
U.S. patent application Ser. No. 10/641,062, Elderson.
U.S. patent application Ser. No. 10/383,047, Brunt.
American Iron and Steel Institute, Low–Rise Residential Construction Details, Publication RG–934, Jun. 1993, p. F.12, Washington, DC.
US Department of Housing and Urban Development, Prescriptive Method For Residential Cold–Formed Steel framing Second Edition, Sep. 1997, pp. 16 and 17, Upper Marlboro, MD.
Zinc Institute Incorporated, Residential Steel Frame Construction, 1982, p. 3A.26, New York, New York.
Unimast Incorporated, Steel Framing Systems Technical Information, 1991, p. 12, Franklin Park, IL.
Manino Industries Corporation, STUD–RITE Lightweight Steel Framing, 1982, Westbury, New York.

* cited by examiner

*Primary Examiner*—Carl Friedman
(74) *Attorney, Agent, or Firm*—Kirkpatrick & Lockhart LLP

(57) ABSTRACT

Apparatus and methods for reinforcing an opening in a support member such as a joist.

35 Claims, 4 Drawing Sheets

APPARATUS FOR REINFORCING A PORTION OF A METAL JOIST ADJACENT AN OPENING THERETHROUGH AND METHODS FOR FORMING REINFORCED OPENINGS IN METAL SUPPORT MEMBERS

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to building members and, more particularly, to apparatuses and methods for reinforcing openings in joists.

2. Description of the Invention Background

Conventional floor construction methods typically comprise installing "header" members on the top of support walls that may be fabricated from, for example, concrete blocks, wood or metal studs. The header members may be fabricated from metal or wood and are supported on the wall. Other beam members, commonly referred to as joists, are used to span from wall to wall between the headers and are connected to the headers by suitable fasteners. The joists are typically arranged parallel to each other with 8", 16" or 24" between their respective centers, depending upon the load characteristics that the floor must accommodate. A sheathing material such as plywood is then attached to the upper edges of the joists to form the floor surface.

After the floor is constructed, other trades must then install the utility members such as pipes, heating ducts, cables, wires, etc. Such utility members must be installed in such a manner so as to not affect the structural integrity of the floor system. Yet it is desirable to support the utility members in the floor system to minimize its intrusion into the livable space and without compromising the structural integrity of the floor.

One method that has been employed in the past for reinforcing an opening provided in a metal joist is illustrated in FIG. 1. As can be seen in that Figure, two pieces of angle 210 are attached to the web 282 of a metal joist 280 adjacent each end of an opening 290 provided in the web 282 When using such approach, the number and configuration of screws used are dependent upon the installation and loading characteristics of the joist.

SUMMARY OF THE INVENTION

In accordance with one form of the present invention, there is provided an apparatus for reinforcing a portion of a metal joist adjacent an opening extending through a portion of the metal joist. In one embodiment, the apparatus comprises a first reinforcement plate having a first side and a second side. The reinforcement plate has a pair of joist attachment ends and the second side has a non-linear profile between the pair of attachment ends.

Another embodiment of the present invention comprises an apparatus for reinforcing a portion of a metal joist adjacent an opening extending through a portion of the metal joist. The apparatus comprises a first C-shaped reinforcement plate that has a front surface and a rear surface and a first leg that protrudes from the front surface and a second leg that protrudes from the front surface. The second leg has an arcuately shaped portion therein. The apparatus also includes a second C-shaped reinforcement plate that has a front surface and a rear surface and a primary leg that protrudes from the front surface and a secondary leg that protrudes from the front surface. The secondary leg has an arcuately shaped portion therein.

Another embodiment of the present invention comprises a method for forming a reinforced opening in the web of a metal support member. One embodiment of the method comprises forming an opening through the web, the opening having a top end portion and a bottom end portion and a width. The method also includes attaching a reinforcement member having a length that is greater than the width of the opening to portions of the web adjacent the opening such that a central portion of the reinforcement member spans across the top end portion or bottom end portion of the opening.

Another embodiment of the present invention comprises a method for forming a reinforced opening in the web of a metal support member. The method includes forming an opening through the web, the opening having a top end portion and a bottom end portion and a width and a height. The method also includes attaching a first reinforcement member having a length that is greater than the width of the opening to portions of the web adjacent the opening such that a central portion of the first reinforcement member spans across the top end portion of the opening. A second reinforcement member having a length that is greater than the width of the opening is attached to portions of the web adjacent the opening such that a central portion of the second reinforcement member spans across the bottom end portion of the opening.

Yet another embodiment of the present invention comprises a method of reinforcing an opening in a support member through which a utility member having an outer perimeter protrudes. The method may include attaching a first reinforcement member having a first edge portion which corresponds in shape to a portion of the perimeter of the utility member to the support member such that the first edge portion is oriented adjacent the portion of the perimeter of the utility member. The method may further include attaching a second reinforcement member having a second edge portion corresponding in shape to another portion of the perimeter of the utility member to the support member such the second edge of the second reinforcement member is oriented adjacent the another portion of the perimeter of the utility member.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
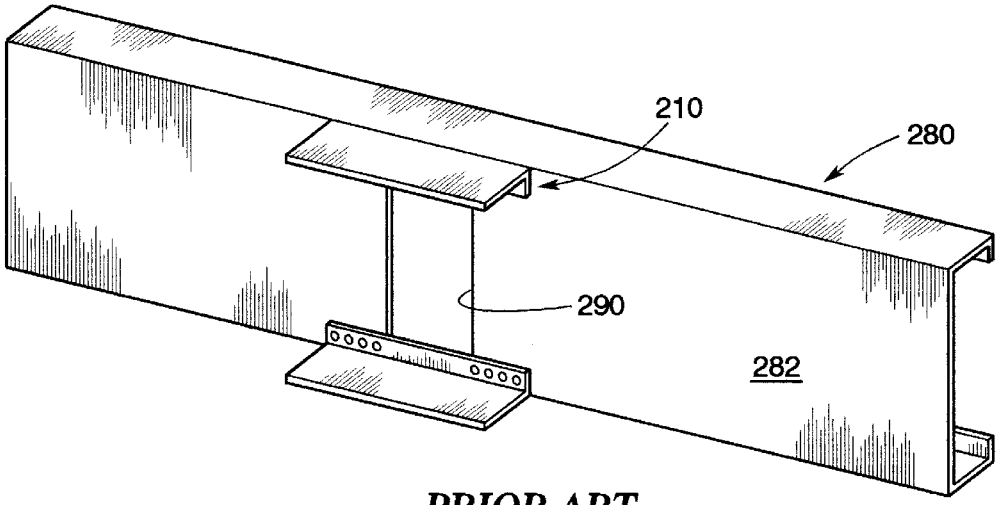
PRIOR ART Fig.1
FIG. 1 is a perspective view of a prior arrangement for reinforcing an opening provided in a metal joist.
Figure 2:
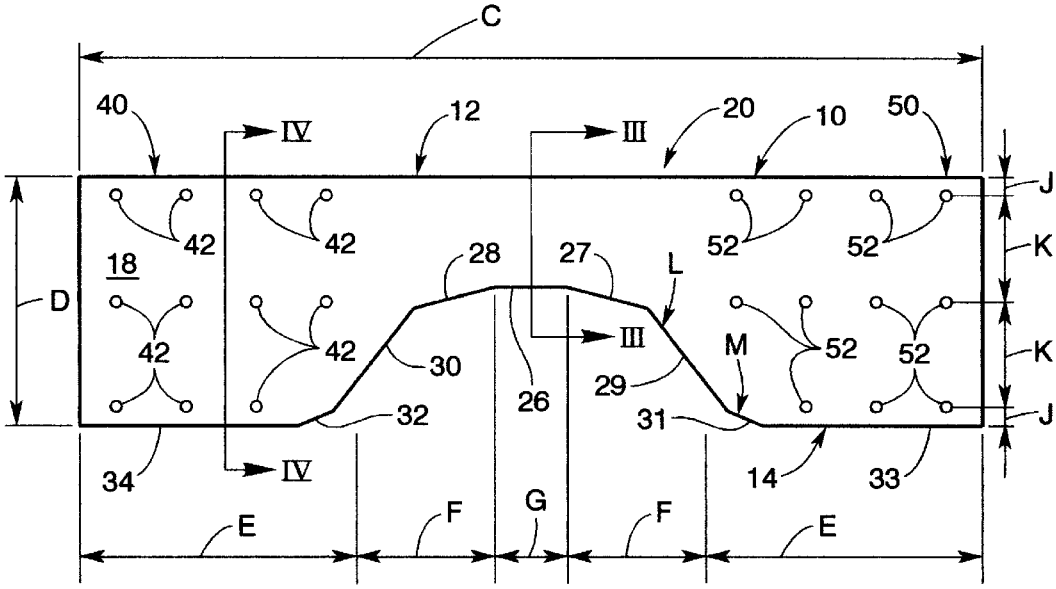
FIG. 2 is a rear elevational view of one embodiment of a reinforcement plate of the present invention.
Figure 3:
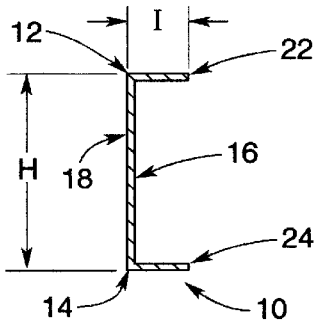
FIG. 3 is a cross-sectional view of the reinforcement plate of FIG. 2 taken along line III—III in FIG. 2.
Figure 4:
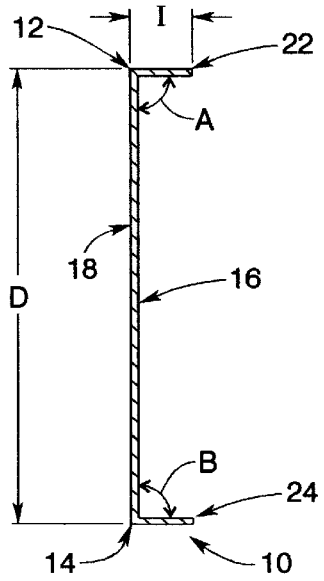
FIG. 4 is a is a cross-sectional view of the reinforcement plate of FIG. 1 taken along line IV—IV in FIG. 2.

Referring now to the drawings for the purposes of illustrating the present embodiments of the invention only and not for the purposes of limiting the same, FIGS. 2–4 illustrate one embodiment of a first reinforcement plate 10 of the present invention. As can be seen in those Figures, the first reinforcement plate 10 has a first lateral edge 12 and a second lateral edge 14. The first reinforcement plate 10 may be fabricated from suitable metal material such as galvanized steel, stainless steel, etc. and have a planar front surface 16 and a planar rear surface 18. In addition, the first reinforcement plate 10 also has a central section generally designated as 20 and two attachment ends, generally designated as 40 and 50.

Also in this embodiment, a first leg 22 protrudes from the first lateral edge at an angle "A" relative to the front surface 16. See FIGS. 3 and 4. In one embodiment, angle "A" is substantially 90°. As used herein, the term "substantially" means within the common tolerances of the manufacturing processes employed to fabricate the member. As can be seen in FIGS. 3 and 4, a second leg 24 also protrudes relative to the second lateral edge 14 at an angle "B" from the front surface 16. In one embodiment, angle "B" is substantially 90°.

Figure 5:
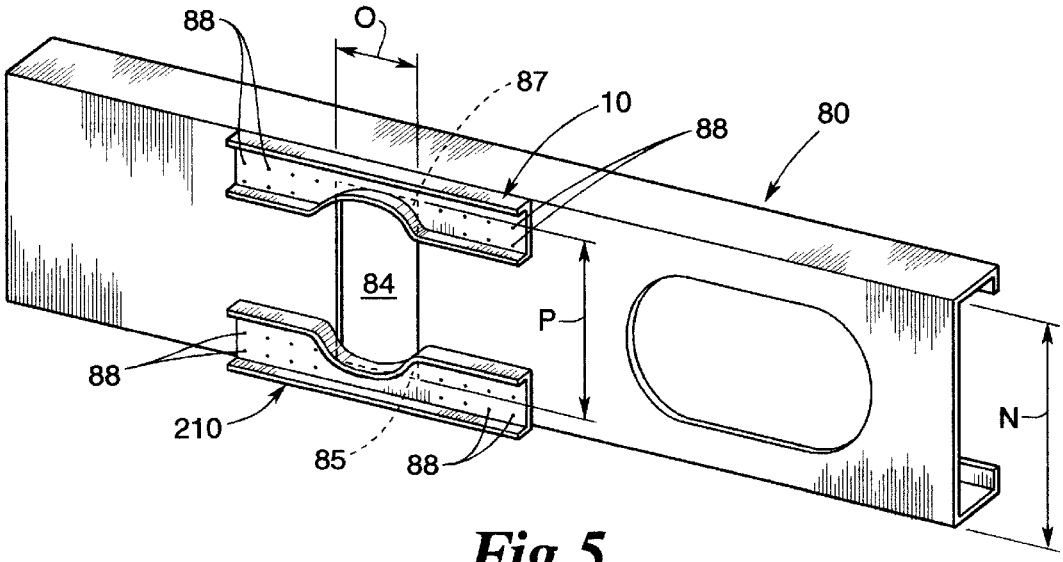
FIG. 5 is perspective view of first and second reinforcement plate embodiments of the present invention attached to a metal joist to reinforce an opening in the web of the metal joist.

To accommodate variously shaped utility members, the second lateral edge 14 and corresponding second leg 24 may have a non-linear shape. For example, as shown in FIGS. 2 and 5, the portion of the second lateral edge 14 and second leg 24 that corresponds to the central portion 20 of the first reinforcement plate 10 is somewhat arcuate. As can be seen in those Figures, the second leg 24 essentially has a central portion 26, and eight segments (27, 28, 29, 30, 31, 32, 33, 34). Such configuration of segments may be formed in the second side and second leg 24 by, for example, conventional steel stamping apparatuses and methods and result in a generally arcuate shape.

In this embodiment, the first joist attachment end 40 is provided with a plurality of attachment holes 42. Likewise, the second joist attachment end 50 has a plurality of joist attachment holes 52 therethrough. Those of ordinary skill in the art will appreciate that fasteners, such as screws, bolts, rivets, etc. may be inserted through the holes and corresponding holes in the web of a joist to attach the reinforcement plate to the joist as will be discussed in further detail below.

FIG. 2 illustrates one embodiment of the first reinforcement plate 10 of the present invention. In that embodiment, the first reinforcement plate 10 is fabricated from steel, plastic, composite material, etc. and is approximately 13 inches (33.02 cm) long (dimension "C") and has a height of approximately 3.5 inches (8.9 cm)(dimension "D"). Also in that embodiment, dimension "E" is approximately 4 inches (10.16 cm), dimension "F" is approximately 2 inches (5.08 cm) and dimension "G" is approximately 1 inch (2.54 cm). Dimension "H" is approximately 1.5 inches (38.1 mm). The first and second legs are each approximately 0.5 inches (12.7 mm) long (dimension "I"). With respect to the fastener holes, dimension "J" is approximately 0.250 inches (6.35 mm) and dimension "K" is approximately 1.5 inches (38.1 mm). Letter "L" represents a two inch (50.88 mm) radius and letter "M" represents a one inch (25.4 mm) radius.

FIG. 5 illustrates the attachment of the first reinforcement plate 10 to the web 82 of a metal joist 80. For example, the installer may cut an opening 84 of desired size and shape in the web 82, with for example, a plasma cutter or saw. Those of ordinary skill in the art will recognize that the opening 84 must be appropriately sized and shaped so as to not compromise the structural integrity of the joist 80 when under load. It can compromise strength if it is fixed afterward. For example, for a 12 inch joist 80 fabricated, the opening 84 may be rectangular in shape and be approximately 4 inches (10.16 cm) long (dimension "O") and 8 inches wide (dimension "P") and have a bottom end portion 85 and a top end portion 87. However, if reinforced "O" may be increased to, for example, 8 inches. After the opening 84 has been formed through the web of the joist 80, the reinforcement plate 10 is oriented as shown in FIG. 5. It will be appreciated that the length of the reinforcement plate 10 (dimension "C") is greater than the length of the opening 84 (dimension "O") such that the reinforcement plate 10 spans across the top end portion 85 (or bottom end portion 87) of the opening 84. If the reinforcement plate 10 is to be attached to the web 82 by mechanical fasteners 88 (i.e., screws, bolts, rivets, etc.), the user may employ the reinforcement plate 10 as a template to drill holes through the web 82 that correspond to the fastener holes (42, 52) in the reinforcement plate 10. Thereafter, fasteners 88 are installed in the aligned fastener holes to affix the reinforcement plate 10 to the web 82. Those of ordinary skill in the art will appreciate that depending upon the particular application, it is conceivable that the reinforcement plate 10 may be welded or glued to the web 82 in addition to or in place of the fasteners 88.

In another embodiment of the present invention, a second reinforcement plate 110 may be employed. The second reinforcement plate 110 may be substantially identical to the first reinforcement plate 10 and have a primary edge 112 and a secondary edge 114. The second reinforcement plate 110 may be fabricated from suitable metal material such as galvanized steel, stainless steel, etc. and have a planar front surface 116 and a planar rear surface 118. In addition, the second reinforcement plate 110 also has a central section generally designated as 120 and two second joist attachment ends, generally designated as 140 and 150.

Figure 7:
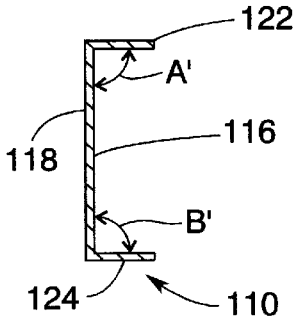
FIG. 7 is a cross-sectional view of the second reinforcement plate of FIG. 6 taken along line VII—VII in FIG. 6.
Figure 8:
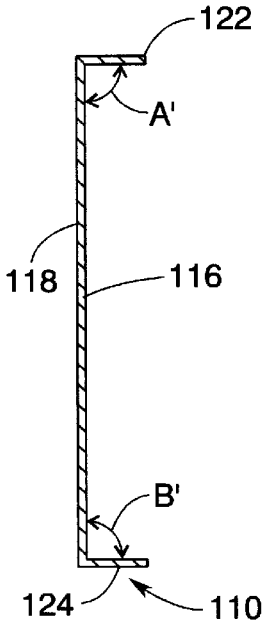
FIG. 8 is a is a cross-sectional view of the reinforcement plate of FIG. 6 taken along line VIII—VIII in FIG. 6.

Also in this embodiment, a primary leg 122 protrudes from the primary lateral edge 112 at an angle "A'" from the front surface 116. In one embodiment, angle "A'" is substantially 90°. As can be seen in FIGS. 7 and 8, a secondary leg 124 also protrudes from the secondary lateral edge 114 at an angle "B'" from the front surface 116. In one embodiment, angle "B'" is substantially 90°.

Figure 6:
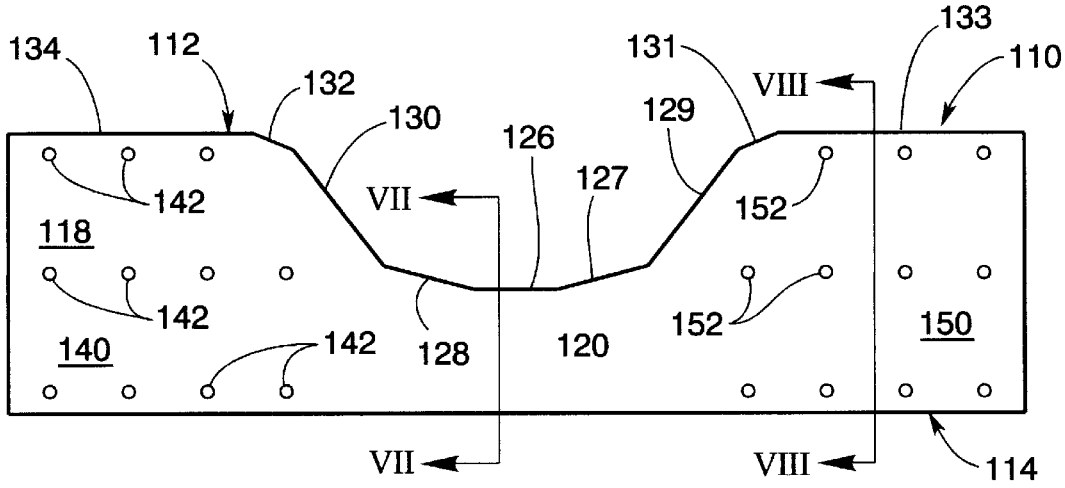
FIG. 6 is a rear elevational view of one embodiment of a second reinforcement plate of the present invention.

To accommodate variously shaped utility members, the secondary edge 114 and corresponding secondary leg 124 may have a non-linear shape. For example, as shown in FIGS. 5 and 6, the portion of the secondary leg 124 that corresponds to the central portion 120 of the second reinforcement plate 110 is somewhat arcuate. As can be seen in those Figures, the secondary leg essentially has a central portion 126, and eight segments (127, 128, 129, 130, 131, 132, 133, 134). Such configuration of segments may be formed in the secondary leg 124 by conventional metal stamping apparatuses and methods and results in a generally arcuate shape.

In this embodiment, each of the second joist attachment ends (140, 150) is provided with a plurality of attachment holes (142, 152), respectively. Those of ordinary skill in the art will appreciate that fasteners 88, such as screws, bolts, rivets, etc. may be inserted through the holes and corresponding holes in the web 82 of a joist 80 to attach the second reinforcement plate 110 to the joist in the same manner as was discussed above with respect to attachment of the first reinforcement plate 10 to the joist web 82.

Figure 9:
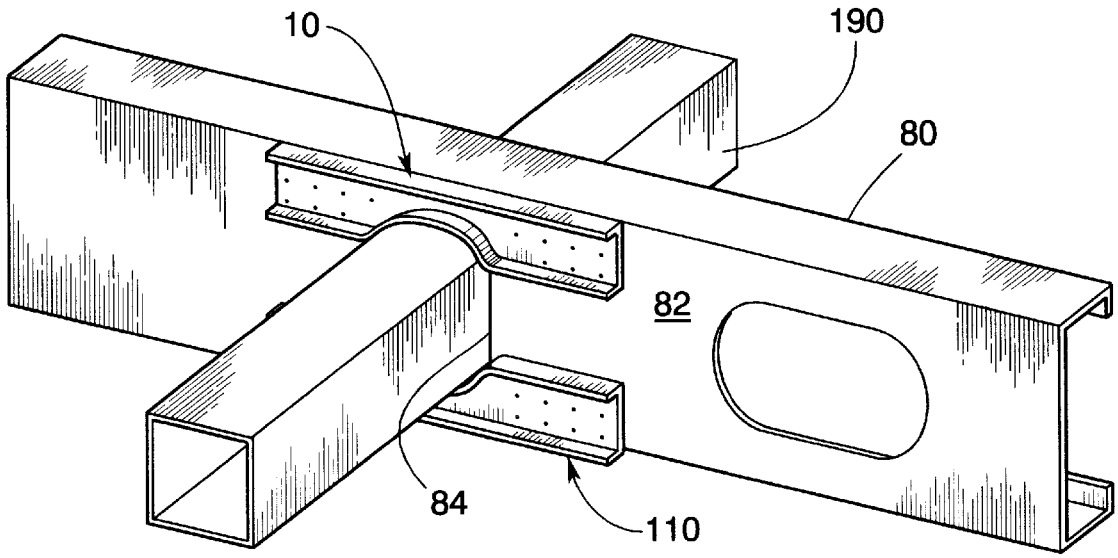
FIG. 9 is a perspective view of first and second reinforcement plate embodiments attached to a metal joist to reinforce an opening therein and a utility member extending through the reinforced opening in the joist.

If desired, a utility member 190 having a shape that corresponds to the shape of the opening 84 as modified by the reinforcement plates may be inserted through the opening. Those of ordinary skill in the art will appreciate that the second and secondary legs (24, 124) of the reinforcement plates (10, 110), respectively may be so shaped to correspond to the shape of the outer perimeter of the utility member 190 when the utility member 190 is inserted through the opening 84. See FIG. 9.

From the above discussion, it is apparent that the present many of the problems encountered when constructing floor systems. For example, various embodiments of the present invention permit the installer to reinforce a hole in a joist or other support member after a utility member has already been installed such that it passes through the hole. This was not possible in the past when using one piece reinforcing members that required the utility member to be passed through an opening in the reinforcing member during installation. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. Apparatus for reinforcing a portion of a metal joist adjacent an opening extending through a portion of the metal joist, said apparatus comprising:

a first reinforcement plate having a pair of joist attachment ends and a first lateral edge that extends between the joist attachment ends in a single plane defined by said first reinforcement plate, said first reinforcement plate further having a second lateral edge opposite said first lateral edge and wherein said second lateral edge has a non-linear profile between said pair of joist attachment ends;

a first leg protruding from at least a portion of said first lateral edge; and a second leg protruding from at least a portion of said second lateral edge and not contacting said first leg.

2. The apparatus of claim 1 wherein said first reinforcement plate has a front surface and a rear surface and wherein said first leg protrudes from said first lateral edge at a first angle relative to said front surface and wherein said second leg protrudes from said second lateral edge at a second angle relative to said front surface.

3. The apparatus of claim 2 wherein said first and second angles are each substantially ninety degrees.

4. The apparatus of claim 1 wherein each said joist attachment portion has at least one fastener hole therethrough.

5. The apparatus of claim 1 wherein said non-linear profile comprises an arcuate shape.

6. The apparatus of claim 1 further comprising a second reinforcement plate having a primary edge and a secondary edge, said second reinforcement plate having a pair of second joist attachment ends and wherein said secondary edge has a second non-linear profile between said pair of second joist attachment ends.

7. The apparatus of claim 6 further comprising:

a primary leg protruding from at least a portion of said primary edge; and a secondary leg protruding from at least a portion of said secondary edge.

8. The apparatus of claim 7 wherein said second reinforcement plate has a front surface and a rear surface and wherein said primary leg protrudes from said primary edge at a primary angle relative to said front surface and wherein said secondary leg protrudes from said secondary edge at a secondary angle relative to said first side.

9. The apparatus of claim 8 wherein said primary and secondary angles are each substantially ninety degrees.

10. The apparatus of claim 6 wherein each said second joist attachment portion has at least one fastener hole therethrough.

11. The apparatus of claim 1 wherein said second non-linear profile comprises an arcuate shape.

12. The apparatus of claim 1 wherein said first reinforcement plate is fabricated from material selected from the group consisting of steel, plastic and composite material.

13. Apparatus for reinforcing a portion of a metal joist adjacent an opening extending through a portion of the metal joist, said apparatus comprising:

a first C-shaped reinforcement plate having a central section with a front surface and a rear surface and a first leg protruding from said front surface and a second leg protruding from said front surface, said second leg having an arcuately shaped portion therein protruding substantially perpendicularly from said central section of said first reinforcement plate; and a second C-shaped reinforcement plate having a central section with a front surface and a rear surface and a primary leg protruding from said front surface and a secondary leg protruding from said front surface, said secondary leg having an arcuately shaped portion therein that protrudes substantially perpendicularly from said central section of said second reinforcement plate.

14. The apparatus of claim 13 wherein said first and second C-shaped reinforcement plates are fabricated from material selected from the group consisting of steel, plastic and composite material.

15. A method of supporting a utility member having an outer perimeter through an opening in a continuous web of a single support member, comprising:

forming an opening through a portion of the web of sufficient size and shape to permit the utility member to extend therethrough, the opening having an upper end portion and a lower end portion;

preforming a first non-linear profile in a first lateral edge of a first reinforcement member such that the first profile corresponds in shape to a portion of the perimeter of the utility member;

attaching the first reinforcement member to the continuous web such that the portion of the first lateral edge having a first profile therein is oriented adjacent the lower end portion of the opening and another portion of the first reinforcement member overlies a portion of the continuous web;

preforming a second profile in a second lateral edge of a second reinforcement member such that the second profile corresponds in shape to another portion of the perimeter of the utility member;

attaching the second reinforcement member to the continuous web such that the second profile is oriented adjacent the upper end portion of the opening and another portion of the second reinforcement member overlies another portion of the continuous web of the support member; and inserting the utility member into the opening such that a portion of the utility member is received between the first and second reinforcement members and protrudes through the opening in the web of the single support member.

16. A method of reinforcing an opening in a web of a support member through which a utility member having an outer perimeter protrudes, the method comprising:

attaching a first planar reinforcement member having a first edge portion which corresponds in shape to a portion of the outer perimeter of the utility member to the web of the support member such that the first edge portion is oriented adjacent the portion of the outer perimeter of the utility member and another portion of the first planar reinforcement member overlies a portion of the web; and attaching a second planar reinforcement member having a second edge portion corresponding in shape to another portion of the outer perimeter of the utility member to the web of the support member such the second edge of the second reinforcement member is oriented adjacent the another portion of the outer perimeter of the utility member and another portion of the second planar reinforcement member overlies another portion of the web.

17. A method of reinforcing an opening in a single support member, the method comprising:

forming an opening in a portion of a web of the support member;

inserting a utility member through the opening;

attaching a first planar reinforcement plate to a planar outer surface of the web adjacent an upper portion of the opening such that a portion of the first planar reinforcement plate overlies a portion of the planar outer surface of the web, the first planar reinforcement plate having a nonlinear cutout that conforms in shape with a portion of an upper periphery of the utility member; and attaching a second planar reinforcement plate to the planar outer surface of the web adjacent a lower portion of the opening, the second planar reinforcement plate having a nonlinear cutout that conforms in shape with a portion of a lower periphery of the utility member.

18. The method of claim 17 wherein said attaching a first planar reinforcement plate comprises affixing the first planar reinforcement plate to the outer surface of the web with mechanical fasteners.

19. The method of claim 17 wherein said attaching a first planar reinforcement plate comprises welding the first planar reinforcement plate to the outer surface of the web.

20. The method of claim 17 wherein said attaching a first planar reinforcement plate comprises gluing the first planar reinforcement to the planar outer surface of the web.

21. The method of claim 17 wherein said attaching a second planar reinforcing plate comprises affixing the second planar reinforcement plate to the outer surface of the web with mechanical fasteners.

22. The method of claim 17 wherein said attaching a second planar reinforcing plate comprises welding the second planar reinforcement plate to the outer surface of the web.

23. The method of claim 17 wherein said attaching said second planar reinforcing plate comprises gluing the second planar reinforcement to the planar outer surface of the web.

24. A joist system comprising:

at least one joist having a planar web with a planar outer surface and an opening through the planar outer surface;

a utility member extending through said opening and extending at an angle relative to said planar outer surface;

a first reinforcement member having an edge corresponding in shape to a portion of the outer perimeter of said utility member, said first reinforcement member being coupled to a portion of said planar outer surface of said web such that at least a portion of said edge is adjacent to said portion of the outer perimeter of said utility member extending through said planar outer surface of said web; and a second reinforcement member having an edge corresponding in shape to another portion of the outer perimeter of said utility member, said second reinforcement member being coupled to another portion of said planar outer surface of said web such that at least a portion of said edge thereof is adjacent to said another portion of the outer perimeter of said utility member extending through said planar outer surface of said web.

25. The joist system of claim 24 wherein said first reinforcement member has a C-shaped cross-sectional shape.

26. The joist system of claim 25 wherein said first reinforcement member comprises:

a first planar portion having a first central portion located between two first joist attachment ends, said first planar portion having a first lateral edge and a second lateral edge;

a first leg protruding from said first planar portion along at least a portion of said first lateral edge; and a second leg portion protruding from at least a portion of said second lateral edge, at least a portion of said second leg said second leg corresponding in shape to said portion of the outer perimeter of said utility member.

27. The joist system of claim 26 further comprising at least one first fastener hole through each said joist attachment ends.

28. The joist system of claim 24 wherein said first reinforcement member is fabricated from material selected from the group consisting of steel, plastic and composite material.

29. Apparatus for reinforcing a portion of a metal joist adjacent an opening extending through a portion of the metal joist, said apparatus comprising:

a first reinforcement plate having a pair of joist attachment ends and a first lateral edge that extends between the joist attachment ends in a single plane defined by said first reinforcement plate, said first reinforcement plate further having a second lateral edge opposite said first lateral edge and wherein said second lateral edge has a non-linear profile between said pair of joist attachment ends;

a second reinforcement plate having a primary edge and a secondary edge, said second reinforcement plate having a pair of second joist attachment ends and wherein said secondary edge has a second non-linear profile between said pair of second joist attachment ends;

a primary leg protruding from at least a portion of said primary edge; and a secondary leg protruding from at least a portion of said secondary edge.

30. The apparatus of claim 29 wherein said second reinforcement plate has a front surface and a rear surface and wherein said primary leg protrudes from said primary edge at a primary angle relative to said front surface and wherein said secondary leg protrudes from said secondary edge at a secondary angle relative to said first side.

31. The apparatus of claim 30 wherein said primary and secondary angles are each substantially ninety degrees.

32. The apparatus of claim 29 wherein each said second joist attachment portion has at least one fastener hole therethrough.

33. A joist system comprising:

at least one joist having a planar web with a planar outer surface and an opening through the planar outer surface;

a utility member extending through said opening and extending at an angle relative to said planar outer surface, said utility member having an outer perimeter; and a first reinforcement member comprising:

a first planar portion having a first central portion located between two first joist attachment ends, said first planar portion having a first lateral edge and a second lateral edge, said first joist attachment ends attached to said planar web of said joist such that at least a portion of said second lateral edge is adjacent to a portion of said outer perimeter of said utility member;

a first leg protruding from said first planar portion along at least a portion of said first lateral edge; and a second leg portion protruding from at least a portion of said second lateral edge, at least a portion of said second leg said second leg corresponding in shape to said portion of the outer perimeter of said utility member and not contacting said first leg.

34. The joist system of claim 33 further comprising at least one first fastener hole through each said joist attachment ends.

35. The joist system of claim 33 wherein said first reinforcement member is fabricated from material selected from the group consisting of steel, plastic and composite material.

* * * * *

UNITED STATES PATENT AND TRADEMARK OFFICE

CERTIFICATE OF CORRECTION

PATENT NO. : 6,691,487 B2
DATED : February 14, 2004
INVENTOR(S) : Larry R. Daudet It is certified that error appears in the above-identified patent and that said Letters Patent is hereby corrected as shown below:

Column 5,
Line 60, delete “portion” and replace therewith -- end --.

Column 6,
Line 13, delete “first side” and replace therewith -- front surface --.
Line 17, delete “portion” and replace therewith -- end --.
Line 19, delete “second”
Line 20, after “profile” insert -- of said second lateral edge --.

Column 7,
Line 25, after “such”, insert -- that --.

Column 8,
Line 45, after “each” insert -- of --.

Column 9,
Line 14, delete “portion” and replace therewith -- end --.

Column 10,
Line 11, after “leg”, delete “portion”.

Signed and Sealed this

Twenty-first Day of June, 2005

JON W. DUDAS
*Director of the United States Patent and Trademark Office*